US006279841B1

(12) United States Patent
McCormick

(10) Patent No.: US 6,279,841 B1
(45) Date of Patent: Aug. 28, 2001

(54) FUEL INJECTION VALVE

(75) Inventor: Michael McCormick, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/509,977

(22) PCT Filed: Mar. 31, 1999

(86) PCT No.: PCT/DE99/00970

§ 371 Date: Apr. 5, 2000

§ 102(e) Date: Apr. 5, 2000

(87) PCT Pub. No.: WO00/08333

PCT Pub. Date: Feb. 17, 2000

(30) Foreign Application Priority Data

Aug. 7, 1998 (DE) ..... 198 35 693

(51) Int. Cl.[7] ..... B05B 1/30

(52) U.S. Cl. ..... 239/585.1; 239/533.9; 239/900; 251/129.21; 267/181; 137/625.65

(58) Field of Search ..... 239/585.1–585.5, 239/533.2–533.12, 900; 251/129.21, 321; 267/181; 137/625.65

(56) References Cited

U.S. PATENT DOCUMENTS 4,065,058 12/1977 Knape et al. .
4,428,559 * 1/1984 Ichiryu et al. ..... 137/625.65
4,585,176 * 4/1986 Kubach et al. ..... 239/900
4,795,098 * 1/1989 Kirchner et al. ..... 239/900
4,830,286 * 5/1989 Asslaender et al. ..... 239/900

FOREIGN PATENT DOCUMENTS 31 39 288 4/1983 (DE) .
33 36 010 4/1985 (DE) .
36 30 092 3/1988 (DE) .
40 03 227 1/1991 (DE) .
41 40 070 6/1993 (DE) .
196 38 201 4/1998 (DE) .
WO93/18299 9/1993 (WO) .

* cited by examiner

*Primary Examiner*—David A. Scherbel
*Assistant Examiner*—Dinh Q. Nguyen
(74) *Attorney, Agent, or Firm*—Kenyon & Kenyon

(57) ABSTRACT

In a fuel injector a valve-closure member movable axially along a valve longitudinal axis and a valve-seat body are provided for opening and closing the valve. Allocated to the valve-seat body is a valve-seat face which cooperates with the valve-closure member. In this context, the valve-closure member is joined to the valve-seat body via a spring element designed in the form of a diaphragm spring. The spring element is arranged in such a manner that it pulls the valve-closure member toward the valve-seat face as a return spring in response to closing of the valve. The fuel injector is particularly suitable for use in fuel-injection systems of mixture-compressing internal combustion engines with externally supplied ignition.

10 Claims, 2 Drawing Sheets

FUEL INJECTION VALVE

BACKGROUND OF THE INVENTION

German Patent No. 40 03 227 describes a fuel injector which, as a valve which can be actuated electromagnetically, is provided with a magnetic circuit and a seat valve. In this valve, a fuel filter intended to keep dirt particles away from the seat region is pressed into a core at its feed end, the core serving as a fuel inlet connection. Moreover, an adjusting sleeve and a helical return spring are also arranged in the longitudinal opening of the core. The pressed-in adjusting sleeve is used to adjust the spring bias of the return spring engaged on it which is braced against the valve needle with its downstream end, pressing the valve-closure member against a valve seat in the closing direction of the valve when the magnetic coil is not excited. Thus, several component parts are fastened in the fuel inlet connection, possibly in a chip-forming manner.

Moreover, it is known from German Patent No. 41 40 070, German Patent No. 196 38 201, or from PCT Patent Publication No. WO 93/18299 to arrange filter elements in fuel injectors near the valve seat.

SUMMARY OF THE INVENTION

The fuel injector according to the present invention has the advantage that it can have a particularly small and compact design. To that end, according to the present invention, a spring element joins the valve-closure member to the valve-seat body.

By using such a spring element, it is possible to substitute a return spring which is arranged in the fuel inlet connection in known fuel injectors and always requires an additional adjusting element, both component parts together mostly being responsible for a longer design of the fuel injector. Besides, the outlay of component parts can be reduced in this manner.

It is an additional advantage that there is no need to provide an exact guide opening in the valve-seat body for guiding the valve needle or the valve-closure member during its axial motion since the valve-closure member is guided and pulled exactly into the valve-seat body by the spring element.

It is particularly advantageous for the spring element to be designed as a diaphragm spring having the form of a sleeve as well as two fastening regions partially enclosing the valve-closure member and the valve-seat body.

Also, it is particularly beneficial for the spring element to be designed as a filter element at the same time. The diaphragm spring provided with a plurality of holes allows particles impairing the tightness of the valve to be filtered out from the fuel near the valve seat. By using such a diaphragm spring having spring and filter functions, it is possible to substitute both a fuel filter arranged in the fuel inlet connection in known fuel injectors and the return spring as well as the adjusting sleeve mostly following downstream in the fuel inlet connection or core so that the outlay of component parts can be reduced even more markedly.

DETAILED DESCRIPTION

Figure 1:
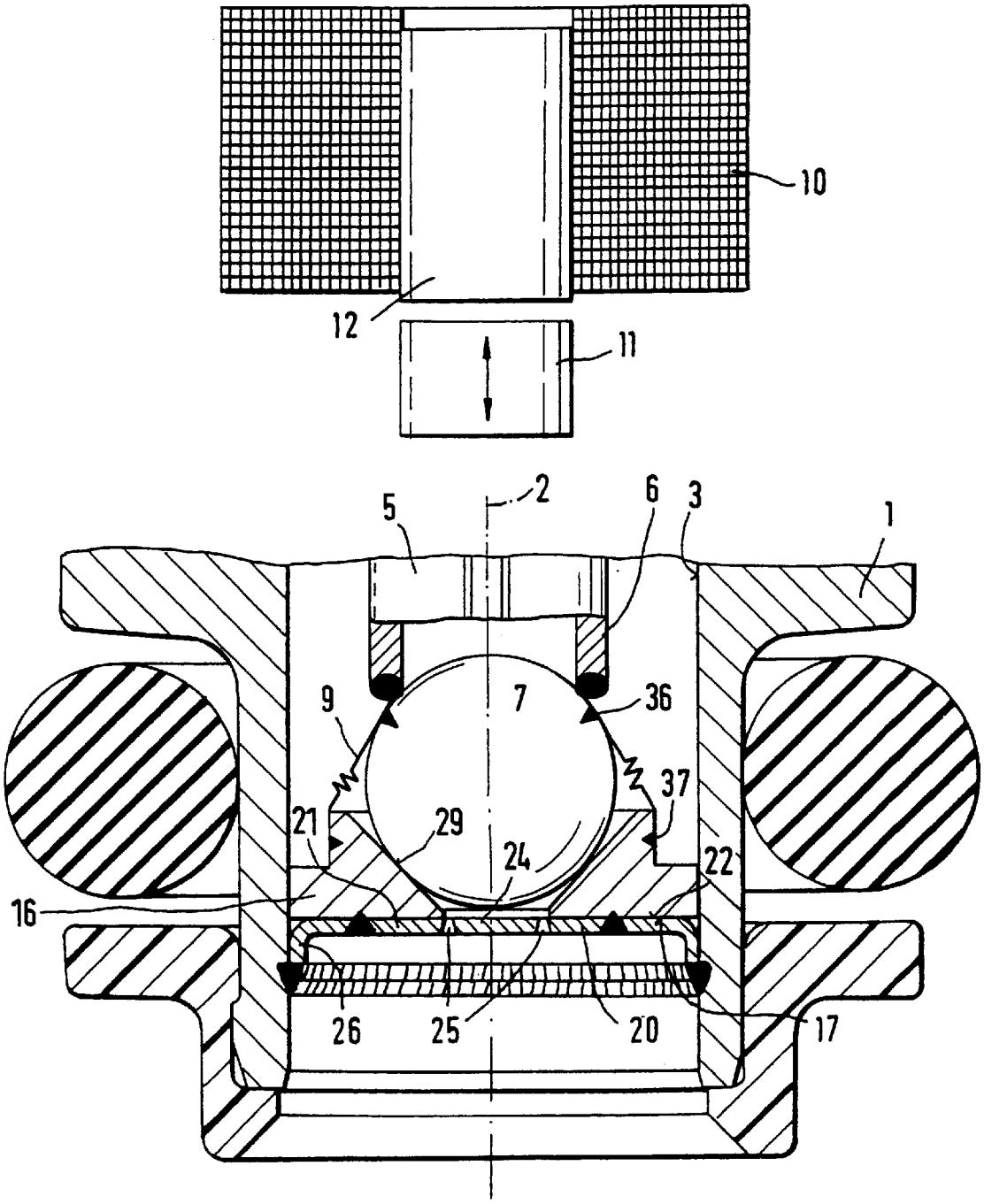
FIG. 1 shows a partial representation of an exemplary embodiment of a fuel injector having a diaphragm spring according to the present invention.

FIG. 1 shows a partial representation of a fuel injector for fuel-injection systems of mixture-compressing internal combustion engines with externally supplied ignition. The fuel injector has a tubular valve-seat support 1 in which a longitudinal opening 3 is provided concentrically to a valve longitudinal axis 2. Arranged in longitudinal opening 3 is, for example, a tubular valve needle 5 which is joined to a spherical valve-closure member 7 at its downstream end 6.

The fuel injector is actuated in known manner, for example, electromagnetically. For axially moving valve needle 5 and, consequently, for opening the fuel injector against the spring force of a spring element 9 acting upon valve-closure member 7 and serving as return spring, and for closing the fuel injector, respectively, a sketched electromagnetic circuit having a magnetic coil 10, an armature 11, and a core 12 is used. Armature 11 is joined to the end of valve needle 5 facing away from valve-closure member 7 by, for example, a weld with the assistance of a laser, and aligned to core 12.

In the downstream end of valve-seat support 1 facing away from core 11, a valve-seat body 16 is mounted in longitudinal opening 3 running concentrically to valve longitudinal axis 2 by welding, forming a seal. At the outer circumference, valve-seat body 16 has, for example, a stepped design, the circumference of valve-seat body 16, at its lower end, having a diameter which is only slightly smaller than that of longitudinal opening 3 of valve-seat support 1. At its one, lower end face 17 facing away from valve-closure member 7, valve-seat body 16 is joined to a base part 20, for example, a pot-shaped spray-orifice plate 21, concentrically and fixedly so that base part 20 engages on lower end face 17 of valve-seat body 16 with its upper end face 22. In its central region 24, base part 20 of spray-orifice plate 21 has at least one, for example, four spray orifices 25 formed by erosive machining or punching. Joining up contiguously to base part 20 is a circular retention rim 26 extending in an axial direction, facing away from valve-seat body 16 and curved outward slightly conically.

The preadjustment of the lift of valve needle 5 is determined by the insertion depth of the valve-seat part composed of valve-seat body 16 and pot-shaped spray-orifice plate 21 into longitudinal opening 3 since one end position of valve needle 5 is determined by the engagement of valve-closure member 7 on a valve-seat face 29 of valve-seat body 16 when magnetic coil 10 is not excited. Spherical valve-closure member 7 cooperates with valve-seat face 29 of valve-seat body 16 as a seat valve, valve-seat face 29 frustoconically tapering in the direction of flow. The other end position of valve needle 5 is determined, for example, by the engagement of armature 11 on core 12 when magnetic coil 10 is excited. Thus, the path between these two end positions of valve needle 5 represents the lift.

In the region of retention rim 26, spray-orifice plate 21 and, consequently, the entire valve-seat part is fixedly joined to the wall of longitudinal opening 3, forming a seal. A tight connection of valve-seat body 16 and spray-orifice plate 21 as well as of spray-orifice plate 21 and valve-seat support 1 is required to prevent the fuel from flowing between longitudinal opening 3 of valve-seat support 1 and the circumference of valve-seat body 16 to spray orifices 25, or between longitudinal opening 3 of valve-seat support 1 and retention rim 26 of spray-orifice plate 21 directly into an intake line of the internal combustion engine.

Figure 2:
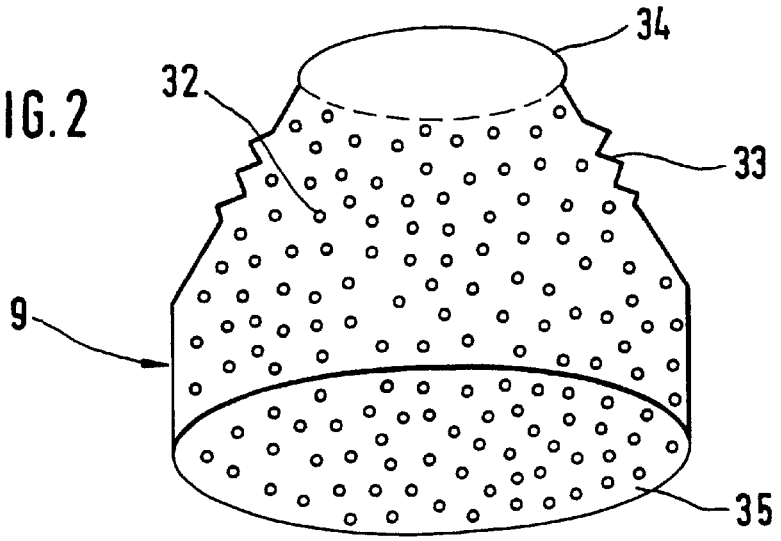
FIG. 2 shows a diaphragm spring as a separate component part according to FIG. 1.

Spring element 9 is designed preferably as a diaphragm spring. Diaphragm spring 9, which is designed as a sleeve-shaped body, extends between valve-closure member 7 and valve-seat body 16. FIG. 2 shows a diaphragm spring 9 as a separate component part on an enlarged scale so that the construction becomes clear. The diaphragm spring fulfills various functions in the fuel injector, on one hand by acting as a return spring pulling valve-closure member 7 toward valve-seat face 29 when magnetic coil 10 is in its non-excited state and, on the other hand, by acting as a filter element, as well. To this end, a plurality of holes 32 are made in a flat raw material (for example, a rolled sheet metal) in a first manufacturing step, for example, by punching, erosive machining or laser boring, for obtaining diaphragm spring 9 according to the present invention. Only subsequently, this flat raw material is brought into a closed sleeve form using appropriate stamping or indenting tools, and a desired spring configuration 33 is molded in the form of a pleating, for example, by pressing. Suited to the magnetic circuit quantities, spring configuration 33 is molded in in such a manner that, when magnetic coil 10 is excited, the spring force is easily overcome by the attractive force acting upon valve-closure member 7, and that the valve closes quickly when magnetic coil 10 is de-energized.

Spring configuration 33 is molded in, for example, an axially middle region of diaphragm spring 9, the region extending in the downstream direction, widening frustoconically. Fastening regions 34, 35 adjoin this middle spring region contiguously on both sides, first fastening region 34 having a markedly smaller diameter than second fastening region 35. Diaphragm spring 9 encloses valve-closure member 7 with first fastening region 34, whereas second fastening region 35 surrounds valve-seat body 16 at the outer circumference at least partially. Both fastening regions 34, 35 of diaphragm spring 9 are fixedly joined to valve-closure member 7 and valve-seat body 16, respectively, by a first and a second annular weld 36, 37, respectively, obtained by laser welding or several welding spots placed over the circumference. Second fastening region 35 is designed, for example, cylindrically by bending the frustoconical contour of diaphragm spring 9. In this manner, the fastening to valve-seat body 16 is made easier.

Figure 3:
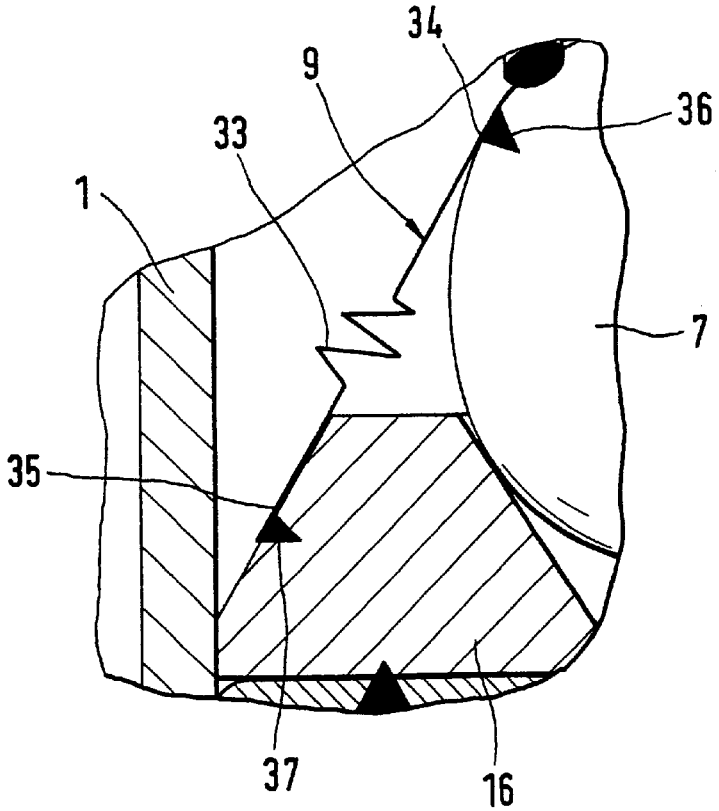
FIG. 3 shows a second diaphragm spring in a cut-away portion of a fuel injector.

As shown in FIG. 3, it is also conceivable for diaphragm spring 9 to be designed completely with a frustoconical contour so that both fastening regions 34, 35 are disposed in one line. To this end, valve-seat body 16 has an at least partially conical outer circumference on which second fastening region 35 engages.

Diaphragm spring 9 provided with a plurality of holes 32 allows particles impairing the tightness of the valve to be filtered out from the fuel near valve seat 16, 29. The at least 100 or even markedly more holes 32 have a diameter which should not be greater than 50 to 60 $\mu$m to be able to ensure the filter function without limitation. By using such a diaphragm spring 9 having spring and filter functions, it is possible to substitute both a fuel filter arranged in the fuel inlet connection in known fuel injectors and a return spring mostly following downstream in the fuel inlet connection or core so that the outlay of component parts is reduced markedly in the present invention.

It is a further advantage that there is no need to provide an exact guide opening in valve-seat body 16 for guiding valve needle 5 or valve-closure member 7 during its axial motion since valve-closure member 7 is guided and pulled exactly into the valve-seat body 16 by spring element 9.

The dynamic spray quantity is adjusted, for example, in such a manner that, first, diaphragm spring 9 is fastened to valve needle 5 and especially to valve-closure member 7 (weld 36). The valve-seat part, together with valve needle 5 and/or armature 11 and diaphragm spring 9 fastened thereto, is brought in an adjusting station and, for the moment, is treated there separately as a valve subassembly. A test valve head subsequently picks up this valve subassembly, the lower end of diaphragm spring 9 being held fast. Then, the valve-seat part is inserted into diaphragm spring 9 from the bottom in the axial direction, for example, by a stepping motor, the valve being excited and the dynamic spray quantity being measured at the same time. Diaphragm spring 9 can be fastened to valve-seat body 16 by second weld 37 as soon as the desired spray quantity is reached.

What is claimed is:

1. A fuel injection valve for supplying an internal combustion engine with fuel, the valve having a longitudinal valve axis, the valve comprising:

a valve-closure member axially movable along the longitudinal valve axis for opening and closing the valve;

a valve-seat body;

a valve-seat face cooperating with the valve-seat body; and a spring element joining the valve-closure member to the valve-seat body;

wherein the spring element is sleeve-shaped and has a spring configuration in a region.

2. The fuel injection valve according to claim 1, wherein the spring element pulls the valve-closure member toward the valve-seat face as a return spring in response to closing of the valve.

3. The fuel injection valve according to claim 1, wherein the spring element includes a diaphragm spring.

4. The fuel injection valve according to claim 1, further comprising:

a first fastening region joining up contiguously to a region above the spring configuration, the first fastening region partially enclosing the valve-closure member; and a second fastening region joining up contiguously to a region below the spring configuration, the second fastening region partially surrounding the valve-seat body.

5. The fuel injection valve according to claim 1, wherein at least the middle region extends in a downstream direction, widening frustoconically.

6. The fuel injection valve according to claim 1, further comprising welds fastening the spring element to the valve-closure member and to the valve-seat body.

7. The fuel injection valve according to claim 1, wherein the valve-closure member is spherical-shaped.

8. The fuel injection valve according to claim 1, wherein the spring element is associated with a filter element for the fuel.

9. The fuel injection valve according to claim 1, wherein the spring element has a plurality of holes having a maximum diameter of 60 $\mu$m.

10. The fuel valve according to claim 1, wherein the region is a middle region of the spring element.

* * * * *